US010640738B2

(12) United States Patent
Thooft et al.

(10) Patent No.: US 10,640,738 B2
(45) Date of Patent: May 5, 2020

(54) PROCESSES FOR MAKING LIQUID DETERGENT COMPOSITIONS COMPRISING A LIQUID CRYSTALLINE PHASE

(71) Applicant: The Procter & Gamble Company, Cincinnati, OH (US)

(72) Inventors: Serge Omer Alfons Jean Thooft, Herzele (BE); Jan-Sebastiaan Uyttersprot, Halle (BE)

(73) Assignee: The Procter and Gamble Company, Cincinnati, OH (US)

( * ) Notice: Subject to any disclaimer, the term of this patent is extended or adjusted under 35 U.S.C. 154(b) by 1 day.

(21) Appl. No.: 15/187,814

(22) Filed: Jun. 21, 2016

(65) Prior Publication Data

US 2016/0369213 A1 Dec. 22, 2016

(30) Foreign Application Priority Data

Jun. 22, 2015 (EP) ..... 15173053
Mar. 31, 2016 (EP) ..... 16163137

(51) Int. Cl.

| | |
|---|---|
| ***C11D 1/83*** | (2006.01) |
| ***C11D 17/00*** | (2006.01) |
| ***C11D 1/02*** | (2006.01) |
| ***C11D 1/66*** | (2006.01) |
| ***C11D 11/00*** | (2006.01) |
| ***C11D 3/04*** | (2006.01) |
| ***C11D 3/382*** | (2006.01) |

(52) U.S. Cl.

CPC ..... *C11D 17/0026* (2013.01); *C11D 1/02* (2013.01); *C11D 1/66* (2013.01); *C11D 1/83* (2013.01); *C11D 3/044* (2013.01); *C11D 3/046* (2013.01); *C11D 3/382* (2013.01); *C11D 11/00* (2013.01)

(58) Field of Classification Search

CPC ..... C11D 1/83; C11D 3/3418; C11D 3/33; C11D 11/0017

See application file for complete search history.

(56) References Cited

U.S. PATENT DOCUMENTS 4,615,819 A * 10/1986 Leng ..... C11D 17/003 510/235
4,677,846 A 7/1987 Lundberg
5,002,688 A * 3/1991 Green ..... C11D 3/1266 510/328
5,021,195 A * 6/1991 Machin ..... C11D 3/14 510/397
5,160,655 A * 11/1992 Donker ..... C11D 3/3947 252/186.25
5,607,910 A * 3/1997 Sherry ..... C11D 1/37 510/235
5,783,533 A * 7/1998 Kensicher ..... A61K 8/0295 424/70.1
5,820,695 A * 10/1998 Lance-Gomez ..... C11D 3/0057 134/25.1
5,836,697 A 11/1998 Chiesa
5,922,664 A * 7/1999 Cao ..... C11D 1/29 510/128
6,426,326 B1 7/2002 Mitra et al.
6,576,602 B1 6/2003 Smerznak et al.
7,297,674 B2 * 11/2007 Hines ..... C11D 1/83 510/276
8,236,748 B2 * 8/2012 Fernandez Prieto ..... C07C 237/22 510/501
8,778,910 B2 * 7/2014 Palla-Venkata ..... A61K 8/92 514/63
2003/0191040 A1 * 10/2003 Adriaanse ..... C11D 3/046 510/267
2005/0192188 A1 * 9/2005 Wagner ..... A61K 8/31 510/130
2007/0068557 A1 * 3/2007 Ortiz ..... C11D 3/37 134/26
2008/0233061 A1 * 9/2008 Gates ..... A01N 25/30 424/59
2009/0048139 A1 * 2/2009 Chen ..... C11D 9/26 510/416
2010/0240571 A1 * 9/2010 Boutique ..... C11D 3/2072 510/338
2010/0292117 A1 * 11/2010 Patel ..... A61K 8/0295 510/130
2011/0061174 A1 * 3/2011 Boutique ..... C11D 1/83 8/137
2011/0065626 A1 3/2011 Courchay
2011/0223125 A1 * 9/2011 Hough ..... A61K 8/8152 424/70.12
2012/0122753 A1 5/2012 Schmiedel et al.
2012/0164198 A1 * 6/2012 Johnson ..... A61K 8/0295 424/401

(Continued)

FOREIGN PATENT DOCUMENTS

EP 2 865 742 A1 4/2015
JP H1247500 1/1985

(Continued)

OTHER PUBLICATIONS

European Search Report for Application No. 1517305308-1357, dated Dec. 17, 2015.

*Primary Examiner* — Charles I Boyer

(74) *Attorney, Agent, or Firm* — Andrés E. Velarde

(57) ABSTRACT

Processes for making stable, structured, liquid detergent compositions, such as liquid laundry detergent compositions, having a high fraction of liquid crystalline phase. Related base mixes and laundry detergent compositions.

5 Claims, No Drawings

(56) References Cited

U.S. PATENT DOCUMENTS

| | | | | |
|---|---|---|---|---|
| 2012/0183591 | A1* | 7/2012 | Dahms | A61K 8/0295<br>424/401 |
| 2013/0276243 | A1* | 10/2013 | Sadlowski | C11D 1/29<br>8/137 |
| 2014/0289969 | A1* | 10/2014 | Sadlowski | C11D 1/29<br>8/137 |
| 2014/0348884 | A1* | 11/2014 | Hilvert | A61K 8/891<br>424/401 |

FOREIGN PATENT DOCUMENTS

| | | | |
|---|---|---|---|
| JP | 2005097603 | A | 4/2005 |
| JP | 200894941 | A | 4/2008 |
| WO | WO9610625 | A1 | 4/1996 |
| WO | WO9712019 | A1 | 4/1997 |
| WO | WO 98/56497 | | 12/1998 |
| WO | WO 2012/164266 | A1 | 12/2012 |

* cited by examiner

PROCESSES FOR MAKING LIQUID DETERGENT COMPOSITIONS COMPRISING A LIQUID CRYSTALLINE PHASE

FIELD OF THE INVENTION

Processes for making stable, structured, liquid detergent compositions, especially liquid laundry detergent compositions, having a high fraction of liquid crystalline phase.

BACKGROUND OF THE INVENTION

Different consumers have different preferences and needs, especially when it comes to detergent compositions for household and laundry cleaning. After cleaning their household surfaces or laundry, all consumers want their homes and clothing to smell clean and fresh. However, different consumers have different ideas as to what perfume denotes a "fresh" smell. In addition, they have different desires when it comes to colours. Moreover, there is also a desire to have variants of detergent compositions with specific types and levels of functional ingredients. For example, detergent compositions comprising specific soil release polymers to provide improved levels of particulate or grease cleaning, or perfume microcapsules to provide longer lasting freshness. Further, in general, liquid cleansing compositions in lamellar phase with low level of strong electrolyte are known.

For simplicity in making, it is desirable to produce such tailored liquid compositions from a common base-mix. Such base mixes comprise the ingredients which are common to the different formulation variants. In order to arrive at the final detergent composition, the differentiating ingredients, and other ingredients, are added at the desired level in order to provide a detergent composition having the desired aesthetics and performance. In order to simplify mixing of such ingredients into the base mix, a low viscosity base mix is desired.

It is desirable to formulate the base-mix with a high level of surfactant in order to simplify storage and transportation, and then dilute the base-mix in order to arrive at the desired surfactant concentration for the finished product.

However, at high surfactant concentrations, a liquid crystalline phase typically forms. Unless the detergent composition is structured, such liquid crystalline phases separate out into a phase which is rich in the liquid crystalline phase. Thus, base mixes are typically formulated with sufficient solvent or hydrotropes in order to limit the amount of such liquid crystalline phase in the base mix, and avoid the base mix from phase-splitting. However, the use of solvents can lead to a base mix having a low flash point, resulting a process which has to be explosion-proofed. Moreover, the resultant final detergent composition also comprises higher levels of solvent, and requires higher levels of structurant in order to arrive at the desired viscosity.

As such, a need remains for a process whereby differentiated liquid detergent compositions can be made from a common stable base mix, without requiring high levels of solvent. In addition, a need remains for a liquid detergent composition which requires little or no external structurant in order to achieve the viscosity and level of structuring desired by consumers.

SUMMARY OF THE INVENTION

The present invention relates to a process for making a detergent composition comprising the steps of: providing a isotropic base mix, wherein the base mix comprises: greater than 15% by weight of surfactant, and less than 1.2% by weight of a non-surfactant salts, adding non-surfactant salt to the isotropic base mix such that the resultant liquid detergent composition comprises at least 15% of a liquid crystalline phase.

The present invention further relates to a liquid detergent composition comprising: from 1% to 70% by weight of surfactant; less than 10% by weight of organic, non-amino-functional solvent, hydrotrope, and mixtures thereof; wherein the liquid detergent composition comprises at least 15% of liquid crystalline phase.

DETAILED DESCRIPTION OF THE INVENTION

By limiting the amount of non-surfactant salt in the base mix, a base mix can be provided in which the amount of liquid crystalline phase is limited, without requiring high levels of solvent or hydrotrope. As a result, a stable readily flowable common base mix can be provided which can later be processed by adding ingredients specific to a particular variant. Moreover, a base mix can be formulated which has a lower flash point. As one of the finishing steps, non-surfactant salt is added, in order to form a liquid crystalline phase. Since the base mix, and subsequent finished product, comprises lower levels of solvent and hydrotrope, a greater amount of liquid crystalline phase is present in the finished product, and less or even no structuring agent needs to be added in order to arrive at the desired viscosity profile.

As used herein, "liquid laundry detergent composition" refers to any laundry treatment composition comprising a fluid capable of wetting and cleaning fabric e.g., clothing, in a domestic washing machine. The composition can include solids or gases in suitably subdivided form, but the overall composition excludes product forms which are nonfluid overall, such as tablets or granules. The liquid detergent compositions preferably have densities in the range from 0.9 to 1.3 grams per cubic centimeter, more specifically from 1.00 to 1.10 grams per cubic centimeter, excluding any solid additives but including any bubbles, if present.

As used herein, the term "external structuring system" refers to a selected compound or mixture of compounds which provide either a sufficient yield stress or low shear viscosity to stabilize the liquid laundry detergent composition independently from, or extrinsic from, any structuring effect of the detersive surfactants of the composition. By "internal structuring" it is meant that the detergent surfactants, which form a major class of laundering ingredients, are relied on for providing the necessary yield stress or low shear viscosity.

All percentages, ratios and proportions used herein are by weight percent of the composition, unless otherwise specified. All average values are calculated "by weight" of the composition or components thereof, unless otherwise expressly indicated.

Base Mix:

The base mix comprises greater than 15% by weight of surfactant. Preferably, the base mix comprises from 15% to 85%, more preferably from 20% to 75%, even more preferably from 25 to 50% by weight of surfactant. In preferred embodiments, the base mix comprises surfactant selected from the group consisting of: anionic surfactant, nonionic surfactant, and mixtures thereof.

Suitable anionic surfactants can be selected from the group consisting of: alkyl sulphates, alkyl ethoxy sulphates, alkyl sulphonates, alkyl benzene sulphonates, fatty acids and their salts, and mixtures thereof. However, by nature, every anionic surfactant known in the art of detergent compositions may be used, such as disclosed in "Surfactant Science Series", Vol. 7, edited by W. M. Linfield, Marcel Dekker. However, the base mix preferably comprises at least a sulphonic acid surfactant, such as a linear alkyl benzene sulphonic acid, but water-soluble salt forms may also be used. Anionic surfactant(s) are typically present at a level of from 1.0% to 70%, preferably from 5.0% to 50% by weight, and more preferably from 10% to 30% by weight of the base mix.

Anionic sulfonate or sulfonic acid surfactants suitable for use herein include the acid and salt forms of linear or branched C5-C20, more preferably C10-C16, more preferably C11-C13 alkylbenzene sulfonates, C5-C20 alkyl ester sulfonates, C6-C22 primary or secondary alkane sulfonates, C5-C20 sulfonated polycarboxylic acids, and any mixtures thereof, but preferably C11-C13 alkylbenzene sulfonates. The aforementioned surfactants can vary widely in their 2-phenyl isomer content.

Anionic sulphate salts suitable for use in the compositions of the invention include the primary and secondary alkyl sulphates, having a linear or branched alkyl or alkenyl moiety having from 9 to 22 carbon atoms or more preferably 12 to 18 carbon atoms. Also useful are beta-branched alkyl sulphate surfactants or mixtures of commercial available materials, having a weight average (of the surfactant or the mixture) branching degree of at least 50%.

Mid-chain branched alkyl sulphates or sulfonates are also suitable anionic surfactants for use in the compositions of the invention. Preferred are the C5-C22, preferably C10-C20 mid-chain branched alkyl primary sulphates. When mixtures are used, a suitable average total number of carbon atoms for the alkyl moieties is preferably within the range of from greater than 14.5 to 17.5. Preferred mono-methyl-branched primary alkyl sulphates are selected from the group consisting of the 3-methyl to 13-methyl pentadecanol sulphates, the corresponding hexadecanol sulphates, and mixtures thereof. Dimethyl derivatives or other biodegradable alkyl sulphates having light branching can similarly be used.

Other suitable anionic surfactants for use herein include fatty methyl ester sulphonates and/or alkyl ethyoxy sulphates (AES) and/or alkyl polyalkoxylated carboxylates (AEC). Mixtures of anionic surfactants can be used, for example mixtures of alkylbenzenesulphonates and AES.

The anionic surfactants are typically present in the form of their salts with alkanolamines or alkali metals such as sodium and potassium.

The base mix preferably comprises fatty acids, fatty acid salts, and mixtures thereof. Preferably, the base mix comprises from 1 wt % to 10 wt %, more preferably from 2 wt % to 7 wt %, most preferably from 3 wt % to 5 wt % of fatty acid, fatty acid salts, and mixtures thereof.

The base mix preferably comprises a nonionic surfactant. Preferably, the base mix comprises up to 15 wt %, more preferably from 1 wt % to 15 wt %, most preferably from 5 wt % to 12 wt % of non-ionic surfactant.

Suitable nonionic surfactants include, but are not limited to C12-C18 alkyl ethoxylates ("AE") including the so-called narrow peaked alkyl ethoxylates and C6-C12 alkyl phenol alkoxylates (especially ethoxylates and mixed ethoxy/propoxy), block alkylene oxide condensate of C6-C12 alkyl phenols, alkylene oxide condensates of C8-C22 alkanols and ethylene oxide/propylene oxide block polymers (Pluronic-BASF Corp.), as well as semi polar nonionics (e.g., amine oxides and phosphine oxides) can be used in the present compositions. An extensive disclosure of these types of surfactants is found in U.S. Pat. No. 3,929,678, Laughlin et al., issued Dec. 30, 1975.

Alkylpolysaccharides such as disclosed in U.S. Pat. No. 4,565,647 Llenado are also useful nonionic surfactants in the compositions of the invention.

Also suitable are alkyl polyglucoside surfactants.

In some embodiments, nonionic surfactants of use include those of the formula $R_1(OC_2H_4)_nOH$, wherein $R_1$ is a C10-C16 alkyl group or a C8-C12 alkyl phenyl group, and n is from preferably 3 to 80. In some embodiments, the nonionic surfactants may be condensation products of C12-C15 alcohols with from 5 to 20 moles of ethylene oxide per mole of alcohol, e.g., C12-C13 alcohol condensed with 6.5 moles of ethylene oxide per mole of alcohol Additional suitable nonionic surfactants include polyhydroxy fatty acid amides of the formula:

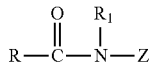

wherein R is a C9-17 alkyl or alkenyl, R1 is a methyl group and Z is glycidyl derived from a reduced sugar or alkoxylated derivative thereof. Examples are N-methyl N-1-deoxyglucityl cocoamide and N-methyl N-1-deoxyglucityl oleamide. Processes for making polyhydroxy fatty acid amides are known and can be found in Wilson, U.S. Pat. No. 2,965,576 and Schwartz, U.S. Pat. No. 2,703,798.

The base mix can comprise addition surfactants, including those selected from the group consisting of: amphoteric and/or zwitterionic surfactants, cationic surfactants, semi-polar surfactants, and mixtures thereof.

Suitable amphoteric or zwitterionic detersive surfactants include those which are known for use in hair care or other personal care cleansing. Non-limiting examples of suitable zwitterionic or amphoteric surfactants are described in U.S. Pat. No. 5,104,646 (Bolich Jr. et al.), U.S. Pat. No. 5,106,609 (Bolich Jr. et al.). Suitable amphoteric detersive surfactants include those surfactants broadly described as derivatives of aliphatic secondary and tertiary amines in which the aliphatic radical can be straight or branched chain and wherein one of the aliphatic substituents contains from 8 to 18 carbon atoms and one contains an anionic group such as carboxy, sulfonate, sulfate, phosphate, or phosphonate. Suitable amphoteric detersive surfactants for use in the present invention include, but are not limited to: cocoamphoacetate, cocoamphodiacetate, lauroamphoacetate, lauroamphodiacetate, and mixtures thereof.

Suitable zwitterionic detersive surfactants are well known in the art, and include those surfactants broadly described as derivatives of aliphatic quaternary ammonium, phosphonium, and sulfonium compounds, in which the aliphatic radicals can be straight or branched chain, and wherein one of the aliphatic substituents contains from 8 to 18 carbon atoms and one contains an anionic group such as carboxy, sulfonate, sulfate, phosphate or phosphonate. Zwitterionics such as betaines are suitable for the base mix.

Suitable semi-polar surfactants include amine oxide surfactants. Amine oxide surfactants having the formula: $R(EO)_x(PO)_y(BO)_zN(O)(CH_2R')_2.qH_2O$ (I) are particularly useful in the base mix of the present invention. R is a relatively long-chain hydrocarbyl moiety which can be saturated or unsaturated, linear or branched, and can contain from 8 to 20, preferably from 10 to 16 carbon atoms, and is more preferably C12-C16 primary alkyl. R' is a short-chain moiety preferably selected from hydrogen, methyl and —$CH_2OH$. When x+y+z is different from 0, EO is ethyleneoxy, PO is propyleneneoxy and BO is butyleneoxy. Amine oxide surfactants are illustrated by $C_{12-14}$ alkyldimethyl amine oxide.

Non-limiting examples of other anionic, zwitterionic, amphoteric or optional additional surfactants suitable for use in the compositions are described in McCutcheon's, Emulsifiers and Detergents, 1989 Annual, published by M. C. Publishing Co., and U.S. Pat. Nos. 3,929,678, 2,658,072; 2,438,091; 2,528,378.

For the process of the present invention, non-surfactant salts do not include amphophilic molecules. As such, a non-surfactant salt does not comprise an ion having a hydrophobic tail bound to a charged group. Hence, non-surfactant salts do not lower the surface tension of the solution. Such non-surfactant salts ionize when dissolved in water and promote the formation of a liquid crystalline phase in the composition. Suitable non-surfactant salts may be selected from the group consisting of: sodium carbonate, sodium hydrogen carbonate (sodium bicarbonate), magnesium chloride, salts of ethylenediaminetetraacetic acid (EDTA), salts of diethylene triamine pentaacetic acid (DTPA), salts of hydroxyethane diphosphonic acid (HEDP), sodium chloride, salts of citric acid, calcium chloride, sodium formate, salts of diethylene triamine penta methylene phosphonic acid, and mixtures thereof. Preferred non-surfactant salts provide addition benefits to the composition, for instance, as a builder. For the purpose of the present invention, non-surfactant salts which provide building benefit are considered first as non-surfactant salts. Salts of ethylenediaminetetraacetic acid (EDTA), diethylene triamine pentaacetic acid (DTPA), hydroxyethane diphosphonic acid (HEDP), citric acid, diethylene triamine penta methylene phosphonic acid, include metal salts such as sodium salts, calcium salts, and magnesium salts, though sodium salts are preferred.

In a preferred embodiment, the base mix comprises less than 1.2 wt %, preferably from 0.1 wt % to 1.2 wt %, more preferably from 0.2 to 0.9 wt %, most preferably from 0.4 wt % to 0.7 wt % of a non-surfactant salts. In more preferred embodiments, the base mix comprises less than 1.2 wt %, preferably from 0.1 wt % to 1.2 wt %, more preferably from 0.2 to 0.9 wt %, most preferably from 0.4 wt % to 0.7 wt % of a non-surfactant salts selected from the group consisting of: sodium carbonate, sodium hydrogen carbonate (sodium bicarbonate), magnesium chloride, ethylenediaminetetraacetic acid (EDTA), diethylene triamine pentaacetic acid (DTPA), hydroxyethane diphosphonic acid (HEDP), sodium citrate, sodium chloride, citric acid, calcium chloride, sodium formate, diethylene triamine penta methylene phosphonic acid, and mixtures thereof.

Where the non-surfactant salt is added to the base mix as a premix, the reserve alkalinity of the premix is preferably sufficiently low that adding the premix to the base mix results in a minor change of the base mix pH.

As a result of the low level of non-surfactant salt, the base mix composition comprises little or no liquid crystalline phase. Preferably, the base mix comprises less than 15%, preferably less than 10%, more preferably less than 5%, most preferably less than 1% by volume of liquid crystalline phase.

Aqueous detergent compositions typically comprise appreciable amounts of surfactants. Above the critical micelle concentration or CMC, the surfactants reorder to form micelles such as spherical, cylindrical (rod-like) and discoidal micelles. As surfactant concentration increases, ordered liquid crystalline phases such as a lamellar phase, hexagonal phase, cubic phase, or combinations thereof, form. The lamellar phase consists of alternating surfactant bilayers and water layers. These layers are not generally flat but fold to form submicron spherical onion like structures called vesicles or liposomes. The hexagonal phase, on the other hand, consists of long cylindrical micelles arranged in a hexagonal lattice. In general, the microstructure of most aqueous detergent compositions consist of either spherical micelles; rod micelles; or a lamellar phase. Micelles may be spherical or rod-like. Formulations having spherical or rod-like micelles tend to have a low viscosity and are more readily processes.

Methods of identifying a liquid crystalline phase are well known to the skilled person, and include such techniques as microscopy, including conical microscopy. For instance, lamellar phase compositions are easy to identify by their characteristic focal conic shape and oily streak texture while hexagonal phase exhibits angular fan-like texture. In contrast, micellar phases are optically isotropic and have little impact on the turbidity of the detergent composition.

It should be understood that liquid crystalline phases may be formed in a wide variety of surfactant systems, as described, for example, in U.S. Pat. No. 5,952,286.

Ways of characterising liquid crystalline phases, are well known to the skilled person, and include microscopy, especially microscopy under cross-polarisers. Micrographs generally will show liquid crystalline microstructure and close packed organisation of the liquid crystalline droplets (generally in size range of about 2 microns). Another way of measuring liquid crystalline phases is using freeze fracture electron microscopy.

The base mix is preferably isotropic. As such, the base mix preferably has a turbidity of from 5 NTU to less than 3000 NTU, preferably less than 1000 NTU, more preferably less than 500 NTU and most preferably less than 100 NTU. Preferably, the base mix is free of suspended matter. Since the base mix composition comprises little or no liquid crystalline phase, the level of solvent and hydrotrope that needs to be present in the base mix is also reduced. As such, the base mix preferably comprises less than 4 wt %, more preferably less than 3.0 wt %, most preferably less than 2.0 wt % of organic, non-aminofunctional solvent, hydrotrope, and mixtures thereof. For the avoidance of doubt, hydrotropes, which are also salts, are considered as hydrotropes for the present invention since such hydrotropes have a larger impact on solubilising the liquid crystalline phase in detergent compositions. Where the base mix comprises less organic, non-aminofunctional solvent, hydrotrope, and mixtures thereof, more liquid crystalline phase is present in the final liquid detergent composition.

As used herein, "non-aminofunctional organic solvent" refers to any solvent which contains no amino functional groups, indeed contains no nitrogen. Non-aminofunctional solvent include, for example: C1-C5 alkanols such as methanol, ethanol and/or propanol and/or 1-ethoxypentanol; C2-C6 diols; C3-C8 alkylene glycols; C3-C8 alkylene glycol mono lower alkyl ethers; glycol dialkyl ether; lower molecular weight polyethylene glycols; C3-C9 triols such as glycerol; and mixtures thereof. More specifically non-aminofunctional solvent are liquids at ambient temperature and pressure (i.e. 21° C. and 1 atmosphere), and comprise carbon, hydrogen and oxygen.

When used, organic non-aminofunctional solvents are preferred. Such organic non-aminofunctional solvents include monohydric alcohols, dihydric alcohols, polyhydric alcohols, glycerol, glycols, polyalkylene glycols such as polyethylene glycol, and mixtures thereof.

If used, highly preferred are mixtures of organic non-aminofunctional solvents, especially mixtures of lower aliphatic alcohols such as propanol, butanol, isopropanol, and/or diols such as 1,2-propanediol or 1,3-propanediol; glycerol; diethylene glycol; or mixtures thereof. Preferred is propanediol (especially 1,2-propanediol), or mixtures of propanediol with diethylene glycol. Preferred base mixes comprise less than 2.5 wt %, preferably less than 1.5 wt %, more preferably less than 1 wt % of methanol or ethanol.

High levels of volatile alcohols have a great impact on the flammability of the composition, especially for liquid compositions. Flammable materials can be categorised according to their closed cup flash point (CCFP) and boiling point, using the following National Fire Protection Association (NFPA) classification:

Class IA—CCFP of less than 73° F. (23° C.) and a boiling point of less than 100° F. (38° C.);

Class IB—CCFP of less than 73° F. (23° C.) and a boiling point of greater than 100° F. (38° C.);

Class IC—CCFP of greater than 73° F. (23° C.) but less than 100° F. (38° C.);

Class II—CCFP is at or above 100° F. (38° C.) but below 140° F. (60° C.);

Class IIIA—CCFP is at or above 140° F. (60° C.) but below 200° F. (93° C.);

Class IIIB—CCFP is at or above 200° F. (93° C.).

The flammability is measured according to the Pensky Martens closed cup flash point (CCFP) test, described in ASTM D93.

Depending on the classification, the requirements for safe handling and storage of the liquid detergent composition changes, including the requirements related to storage location and temperature control. As such, the base mix preferably has an NFPA classification of IC, preferably II, more preferably IIIA, most preferably IIIB.

Suitable hydrotropes include anionic-type hydrotropes, particularly sodium, potassium, and ammonium xylene sulfonate, sodium, potassium and ammonium toluene sulfonate, sodium potassium and ammonium cumene sulfonate, and mixtures thereof, as disclosed in U.S. Pat. No. 3,915,903.

For ease of processing, the base mix preferably has a viscosity of from 0.010 to 2 Pa·s, measured at 20 $s^{-1}$ and 20° C. Moreover, since the base mix composition comprises little or no liquid crystalline phase, or other suspended matter, the base mix is less prone to phase splitting. As a result, little or no structurant is required in the base mix. Therefore, the base mix preferably comprises less than 2 wt %, more preferably less than 1 wt % of an external structurant. Even more preferred, the base mix does not comprise any external structurant.

For improved stability, especially when the base mix comprises fatty acid, the base mix preferably has a pH of from 6.5 to 13, more preferably 7 to 10, most preferably 8 to 9, measured as a 10 wt % solution diluted in deionised water at 25° C. In order to have a stable pH, the base mix preferably has a reserve alkalinity of from 0.20 to 0.30 g NaOH/100 g at pH 7.5.

The base mix preferably comprises water. The water content is preferably from 1% to 70%, preferably from 10% to 65%, more preferably from 30% to 55% by weight of the base mix.

The base mix or subsequent liquid detergent composition can comprise additional ingredients, such as those selected from the group consisting of: polymer deposition aid, organic builder and/or chelant, enzymes, enzyme stabiliser, cleaning polymers, and mixtures thereof.

Polymer Deposition Aid: The base mix can comprise from 0.1% to 7%, more preferably from 0.2% to 3%, of a polymer deposition aid. As used herein, "polymer deposition aid" refers to any cationic polymer or combination of cationic polymers that significantly enhance deposition of a fabric care benefit agent onto the fabric during laundering. Suitable polymer deposition aids can comprise a cationic polysaccharide and/or a copolymer. "Fabric care benefit agent" as used herein refers to any material that can provide fabric care benefits. Non-limiting examples of fabric care benefit agents include: silicone derivatives, oily sugar derivatives, dispersible polyolefins, polymer latexes, cationic surfactants and combinations thereof. Preferably, the deposition aid is a cationic or amphoteric polymer. The cationic charge density of the polymer preferably ranges from 0.05 milliequivalents/g to 6 milliequivalents/g. The charge density is calculated by dividing the number of net charge per repeating unit by the molecular weight of the repeating unit. In one embodiment, the charge density varies from 0.1 milliequivalents/g to 3 milliequivalents/g. The positive charges could be on the backbone of the polymers or the side chains of polymers.

Organic Builder and/or Chelant: The base mix can comprise from 0.6% to 10%, preferably from 2 to 7% by weight of one or more organic builder and/or chelants. Suitable organic builders and/or chelants are selected from the group consisting of: MEA citrate, citric acid, aminoalkylenepoly (alkylene phosphonates), alkali metal ethane 1-hydroxy disphosphonates, and nitrilotrimethylene, phosphonates, diethylene triamine penta (methylene phosphonic acid) (DTPMP), ethylene diamine tetra(methylene phosphonic acid) (DDTMP), hexamethylene diamine tetra(methylene phosphonic acid), hydroxy-ethylene 1,1 diphosphonic acid (HEDP), hydroxyethane dimethylene phosphonic acid, ethylene di-amine di-succinic acid (EDDS), ethylene diamine tetraacetic acid (EDTA), hydroxyethylethylenediamine triacetate (HEDTA), nitrilotriacetate (NTA), methylglycinediacetate (MGDA), iminodisuccinate (IDS), hydroxyethyliminodisuccinate (HIDS), hydroxyethyliminodiacetate (HEIDA), glycine diacetate (GLDA), diethylene triamine pentaacetic acid (DTPA), catechol sulfonates such as Tiron™ and mixtures thereof.

Enzymes: Suitable enzymes provide cleaning performance and/or fabric care benefits. Examples of suitable enzymes include, but are not limited to, hemicellulases, peroxidases, proteases, cellulases, xylanases, lipases, phospholipases, esterases, cutinases, pectinases, keratanases, reductases, oxidases, phenoloxidases, lipoxygenases, lignin-ases, pullulanases, tannases, pentosanases, malanases, β-glucanases, arabinosidases, hyaluronidase, chondroitinase, laccase, and known amylases, or combinations thereof. A preferred enzyme combination comprises a cocktail of conventional detersive enzymes such as protease, lipase, cutinase and/or cellulase in conjunction with amylase. Detersive enzymes are described in greater detail in U.S. Pat. No. 6,579,839.

Enzyme Stabiliser: Enzymes can be stabilized using any known stabilizer system such as calcium and/or magnesium compounds, boron compounds and substituted boric acids, aromatic borate esters, peptides and peptide derivatives, polyols, low molecular weight carboxylates, relatively hydrophobic organic compounds [e.g. certain esters, diakyl glycol ethers, alcohols or alcohol alkoxylates], alkyl ether carboxylate in addition to a calcium ion source, benzamidine hypochlorite, lower aliphatic alcohols and carboxylic acids, N,N-bis(carboxymethyl) serine salts; (meth)acrylic acid-(meth)acrylic acid ester copolymer and PEG; lignin compound, polyamide oligomer, glycolic acid or its salts; poly hexa methylene bi guanide or N,N-bis-3-amino-propyl-dodecyl amine or salt; and mixtures thereof.

Cleaning Polymers: Suitable cleaning polymers provide for broad-range soil cleaning of surfaces and fabrics and/or suspension of the soils. Any suitable cleaning polymer may be of use. Useful cleaning polymers are described in USPN 2009/0124528A1. Non-limiting examples of useful categories of cleaning polymers include: amphiphilic alkoxylated grease cleaning polymers; clay soil cleaning polymers; soil release polymers; and soil suspending polymers.

Process of Making a Liquid Detergent Composition"

In the process of the present invention, non-surfactant salt is added to the base mix such that the resultant liquid detergent composition comprises at least 15% of a liquid crystalline phase. The liquid crystalline phase is desired in the finished detergent composition since their presence typically means that less, or no, external structurant is required to achieve the desired finished product viscosity.

The concentration at which the surfactants form a liquid crystalline phase is lowered by adding a suitable non-surfactant salt. Liquid crystalline dispersions, particularly lamellar dispersions, differ from both spherical and rod-like micelles because they can have high zero shear viscosity (because of the close packed arrangement of constituent liquid crystalline droplets), yet these solutions are very shear thinning. Because of the difference in density, liquid crystalline phases tend to induce phase separation, leading to a distinct liquid crystalline rich phase and a phase having low liquid crystalline content. As such, liquid crystalline phases are typically undesirable in a base mix which can be stored for extended periods before being processed in to the finished detergent composition.

Preferably, the non-surfactant salts is added until the liquid detergent composition comprises from 15% to 85%, preferably from 5% to 70%, more preferably from 10% to 60% of the liquid crystalline phase. The non-surfactant salt is typically added to provide a level of at least 1.5 wt %, preferably from 1.5 wt % to 10 wt %, more preferably 2.5 wt % to 7 wt %, most preferably from 3 wt % to 5 wt % of non-surfactant salt in the liquid detergent composition.

Suitable non-surfactant salts, to be added to the base-mix in order to form the liquid crystalline phase, may be selected from the group consisting of: sodium carbonate, sodium hydrogen carbonate (sodium bicarbonate), magnesium chloride, ethylenediaminetetraacetic acid (EDTA), diethylene triamine pentaacetic acid (DTPA), hydroxyethane diphosphonic acid (HEDP), sodium citrate, sodium chloride, citric acid, calcium chloride, sodium formate, Diethylene triamine penta methylene phosphonic acid, and mixtures thereof.

In a preferred embodiment, a non-surfactant salts selected from the group consisting of: sodium carbonate, sodium hydrogen carbonate (sodium bicarbonate), magnesium chloride, ethylenediaminetetraacetic acid (EDTA), diethylene triamine pentaacetic acid (DTPA), hydroxyethane diphosphonic acid (HEDP), sodium citrate, sodium chloride, citric acid, calcium chloride, sodium formate, diethylene triamine penta methylene phosphonic acid, and mixtures thereof, is added to the base mix at a level of from 0.1 wt % to 10 wt %, more preferably from 0.8 to 7 wt %, most preferably from 1.6 wt % to 3.5 wt % of the resultant liquid detergent.

In a more preferred embodiment, a non-surfactant salts selected from the group consisting of: sodium citrate, sodium chloride, citric acid, calcium chloride, sodium formate, sodium carbonate, sodium hydrogen carbonate (sodium bicarbonate), magnesium chloride, and mixtures thereof, is added to the base mix at a level of from 0.1 wt % to 10 wt %, more preferably from 0.8 wt % to 7 wt %, most preferably from 1.6 wt % to 3.5 wt % of the resultant liquid detergent composition.

The non-surfactant salts can be added as part of a salt premix. Such salt premixes typically do not comprise surfactant. Suitable salt premixes can comprise non-surfactant salts selected from the group consisting of: sodium carbonate, sodium hydrogen carbonate (sodium bicarbonate), magnesium chloride, ethylenediaminetetraacetic acid (EDTA), diethylene triamine pentaacetic acid (DTPA), hydroxyethane diphosphonic acid (HEDP), sodium citrate, sodium chloride, citric acid, calcium chloride, sodium formate, diethylene triamine penta methylene phosphonic acid, and mixtures thereof.

The base mix is typically more concentrated than the desired final liquid detergent composition. As such, water is typically added, such that the desired concentration of the active ingredients is reached. Preferably, sufficient water is typically added, in order to provide a liquid laundry detergent composition having a surfactant level of from 5 wt % to 40 wt %, preferably from 12 wt % to 30 wt % of the finished product.

Non-surfactant salts can be used to increase the structuring or viscosity of a liquid detergent composition comprising an external structurant, since such non-surfactant salts increase the amount of liquid crystalline phase present in the liquid detergent composition.

As such, a liquid detergent composition can be structured through a method having the steps of:

a) providing a liquid detergent composition comprising greater than 15% of a liquid crystalline phase; and b) adding an external structurant.

Preferably, the liquid detergent composition is provided for by a base mix of use in processes of the present invention, in which the liquid crystalline phase is formed by the addition of the non-surfactant salt. Since the liquid crystalline phase is overall neutrally charged, preferred external structurants are those that do not rely on charge—charge interactions for providing a structuring benefit. As such, particularly preferred external structurants are uncharged external structurants, such as those selected from the group consisting of: non-polymeric crystalline, hydroxyl functional structurants, such as hydrogenated castor oil; microfibrillated cellulose; uncharged hydroxyethyl cellulose; uncharged hydrophobically modified hydroxyethyl cellulose; hydrophobically modified ethoxylated urethanes; hydrophobically modified non-ionic polyols; and mixtures thereof.

Adjunct ingredients can be added to the liquid detergent composition, depending on the desired cleaning or surface care benefit that is desired. For liquid laundry detergent compositions, suitable adjunct ingredients can be selected from the group consisting of: cationic surfactants, amphoteric and/or zwitterionic surfactants, enzymes, enzyme stabilizers, amphiphilic alkoxylated grease cleaning polymers, clay soil cleaning polymers, soil release polymers, soil suspending polymers, bleaching systems, optical brighteners, hueing dyes, particulate material, perfume and other odour control agents, hydrotropes, suds suppressors, fabric care benefit agents, pH adjusting agents, dye transfer inhibiting agents, preservatives, non-fabric substantive dyes and mixtures thereof.

In preferred embodiments, an external structurant is added to the liquid detergent composition, in order to structure the resultant liquid crystalline phase, and any other suspended matter which may have been added. The external structurant is preferably added at a level of from 0.05% to 2%, preferably from 0.07% to 1%, more preferably from 0.1% to 0.38%, most preferably from 0.15% to 0.3% by weight of the liquid detergent composition. The external structuring system is preferably selected from the group consisting of:

i. non-polymeric crystalline, hydroxy-functional structurants and/or
ii. polymeric structurants Such external structuring systems are those which impart a sufficient yield stress or low shear viscosity to stabilize the fluid laundry detergent composition independently from, or extrinsic from, any structuring effect of the detersive surfactants of the composition. Preferably, they impart to the fluid laundry detergent composition a high shear viscosity at 1 $s^{-1}$ at 20° C. of from 1 to 6500 cps, at 100/s more than 60 cps and a viscosity at low shear (0.05 $s^{-1}$ at 20° C.) of greater than 5000 cps.

Suitable non-polymeric crystalline, hydroxyl functional structurants are known in the art, and generally comprise a cystallizable glyceride which can be pre-emulsified to aid dispersion into the final liquid detergent composition. A non-limiting example of such a pre-emulsified external structuring system comprises: (a) crystallizable glyceride(s); (b) anionic surfactant; and (c) water and optionally, non-aminofunctional organic solvents. Each of these components is discussed in detail below. The preferred non-polymeric crystalline, hydroxy-functional structurant comprises a crystallizable glyceride, preferably hydrogenated castor oil or "HCO".

Suitable polymeric structurants include naturally derived and/or synthetic polymeric structurants. Examples of naturally derived polymeric structurants of use in the present invention include: microfibrillated cellulose, hydroxyethyl cellulose, hydrophobically modified hydroxyethyl cellulose, carboxymethyl cellulose, polysaccharide derivatives and mixtures thereof. Non-limiting examples of microfibrillated cellulose are described in WO 2009/101545 A1. Suitable polysaccharide derivatives include: pectine, alginate, arabinogalactan (gum Arabic), carrageenan, gellan gum, xanthan gum, guar gum and mixtures thereof.

Examples of synthetic polymeric structurants of use in the present invention include: polycarboxylates, polyacrylates, hydrophobically modified ethoxylated urethanes, hydrophobically modified non-ionic polyols and mixtures thereof.

Preferably the polycarboxylate polymer is a polyacrylate, polymethacrylate or mixtures thereof. In another preferred embodiment, the polyacrylate is a copolymer of unsaturated mono- or di-carbonic acid and 1-30C alkyl ester of the (meth) acrylic acid. Such copolymers are available from Noveon inc under the tradename Carbopol Aqua 30.

Non-surfactant salts can also be used to structure or increase the viscosity of liquid detergent compositions, even without the presence of an external structurant, since the non-surfactant salt increases the size of the liquid crystalline phase, and hence increases the viscosity of the liquid detergent composition. Moreover, when the non-surfactant salt is added at such a level that the liquid detergent composition comprises a liquid crystalline phase, especially a lamellar phase, at a level of from 15% to 85%, preferably from 5% to 70%, more preferably from 10% to 60% of the liquid crystalline phase, the non-surfactant salt acts as a viscosity modifier and/or structuring agent.

In a preferred embodiment, the different ingredients are added to the base mix in a continuous process. In the preferred continuous process, the base mix is pumped through a suitably sized pipe, into which the different ingredients are added at various inlets distributed along the pipe. Preferably, there is a mixing device after at the last ingredient inlet. More preferably, and in order to improve mixing, mixing devices are located at several points along the pipe. Suitable mixing devices can include static and dynamic mixer devices. Examples of dynamic mixer devices are homogenizers, rotor-stators, and high shear mixers. The mixing device could be a plurality of mixing devices arranged in series or parallel in order to provide the necessary energy dissipation rate.

The processes of the present invention result in liquid detergent compositions having a greater amount of liquid crystalline phase, which are either self-structuring, or can be structured using less external structurant.

Such liquid detergent compositions preferably comprise from 1 wt % to 70 wt % of surfactant, less than 10 wt % of organic, non-aminofunctional solvent, hydrotrope, and mixtures thereof, and comprises at least 15% of a liquid crystalline phase, as measured using the method disclosed herein. In more preferred embodiments, the liquid detergent composition comprises from 15% to 85%, preferably from 5% to 70%, more preferably from 10% to 60% of the liquid crystalline phase. In preferred embodiments, the liquid detergent composition comprises from 2 wt % to 50 wt %, more preferably from 5 wt % to 40 wt %, most preferably from 12 wt % to 30 wt % of surfactant.

The liquid detergent composition preferably comprises less than 2.5 wt %, preferably less than 2 wt %, more preferably less than 1.2 wt % of organic, non-aminofunctional solvent, hydrotrope, and mixtures thereof of solvent, hydrotrope, and mixtures thereof.

In more preferred embodiments, the liquid detergent composition comprises from 1 wt % to 10 wt % of fatty acid, and has a pH of from 6.5 to 13, measured as a 10 wt % solution diluted in deionised water at 25° C.

The liquid detergent composition can comprise an external structurant, preferably at a level of from 0.05% to 2%, more preferably from 0.07% to 1%, even more preferably from 0.1% to 0.38% by weight of the liquid detergent composition.

Methods:

A) Method of Evaluating the Phase Stability of Fluid Laundry Detergent Compositions:

The phase stability of the composition is evaluated by placing 300 ml of the composition in a glass jar for up to a time period of 21 days at 25° C. They are stable to phase splits if, within said time period, (i) they are free from splitting into two or more layers or, (ii) said composition splits into layers, a major layer comprising at least 90%, preferably 95%, more preferably 99% by volume of the composition is present.

B) Method of Measuring Viscosity:

The viscosity is measured using an AR 550 rheometer from TA instruments using a plate steel spindle at 40 mm diameter and a gap size of 500 μm. The high shear viscosity at 100 $s^{-1}$ and low shear viscosity at 0.05 $s^{-1}$ can be obtained from a logarithmic shear rate sweep from 0.05 $s^{-1}$ to 1200 $s^{-1}$ in 3 minutes time at 21° C.

C) Turbidity (NTU):

The turbidity (measured in NTU: Nephelometric Turbidity Units) is measured using a Hach 2100P turbidity meter calibrated according to the procedure provided by the manufacture. The sample vials are filled with 15 ml of representative sample and capped and cleaned according to the operating instructions. If necessary, the samples are degassed to remove any bubbles either by applying a vacuum or using an ultrasonic bath (see operating manual for procedure). The turbidity is measured using the automatic range selection.

D) Percentage of Liquid Crystalline Phase:

Product is prepared, without the presence of external structurants, and without particulates or other solids which do not dissolve in the product. The product sample is then put in storage in scaled centrifuge tubes for a minimum of 1 day at 5° C. and then centrifuged for 1 h at 4400 rpm. After centrifugation, the % liquid crystalline phase is measured as the height of the liquid crystalline phase with a ruler compared to the total height of the centrifuged sample.

E) Method of Measuring pH:

The pH is measured, at 25° C., using a Santarius PT-10P pH meter with gel-filled probe (such as the Toledo probe, part number 52 000 100), calibrated according to the instructions manual.

EXAMPLES

Base mix 1, for use in processes of the present invention, was prepared by simple mixing. The resultant base mix was isotropic, comprising no liquid crystalline phase.

Base mix 2 was prepared in a similar manner, but comprised 1.8 wt % of HEDP. Since HEDP is acidic, 0.6 wt % of additional sodium hydroxide was added in order to arrive at the target pH. The addition of HEDP resulted in a base mix which was cloudy and comprised 15% of liquid crystalline phase. As can be seen from Base Mix 3, 2.3 wt % of additional ethanol was needed to disperse the liquid crystalline phase of base mix 2, and provide a stable, isotropic base mix.

Similarly, when the base mix comprised 1.5 wt % of citric acid, 2.1 wt % of additional ethanol was needed to disperse the liquid crystalline phase, and provide a stable, isotropic base mix (see base mix 4 and 5).

When the base mix comprised 1.0 wt % of sodium carbonate, 2.3 wt % of additional ethanol was needed to disperse the liquid crystalline phase, and provide a stable, isotropic base mix (see base mix 6 and 7).

As can be seen from the above data, when the base mix comprises greater than 15 wt % of surfactant and less than 1.2 wt % of non-surfactant salt, a stable, transparent base mix is formed. Increasing the amount of non-surfactant salt results in the formation of a liquid crystalline phase which results in phase separation unless the base mix is kept under constant agitation (see base mixes 2, 4, and 6). In order to provide a stable, transparent base mix, ethanol has to be added in order to reduce the amount of liquid crystalline phase to a negligible level (less than 2 wt %, see base mixes 3, 5, and 7).

Base mix 8 (for use in processes of the present invention) and base mix 9 (for use in comparative processes) were prepared by simple mixing.

Base mix 8 comprised a total of 2.3 wt % of hydrotrope (sodium cumene sulphonate) and organic non-aminofunctional solvent (ethanol) on order to be both isotropic and stable. In contrast, base mix 9 comprised a total of 4.1 wt % of hydrotrope (sodium cumene sulphonate) and organic non-aminofunctional solvent (ethanol) in order to provide a stable, isotropic base.

| Ingredient | Base Mix 8 (Inventive) | Base Mix 9 (Comparative) |
|---|---|---|
| Sodium hydroxide | 2.60 | 5.40 |
| Sodium cumenesulfonate | 0.72 | 2.61 |
| Linear alkyl benzene sulphonic acid | 16.05 | 14.92 |
| C14-15 EO7 | 9.31 | 8.65 |
| C12-14 AE3S | 1.93 | 1.79 |
| Diethylene triamine penta methylene phosphonic acid | 0.80 | 0.75 |
| TPK fatty acid | 4.17 | 3.88 |
| Trans-sulphated Ethoxylated hexamethylene diamine quaternary zwitterionic | 0.96 | 0.90 |
| Ethanol | 1.60 | 1.49 |
| Citric acid | — | 4.69 |

| | Base mix 1 wt % | Base mix 2* wt % | Base mix 3* wt % | Base mix 4* wt % | Base mix 5* wt % | Base mix 6* wt % | Base mix 7* wt % |
|---|---|---|---|---|---|---|---|
| Sodium hydroxide | 2.5 | 2.5 | 2.5 | 2.5 | 2.5 | 2.5 | 2.5 |
| Sodium cumene sulphonate | 0.8 | 0.8 | 0.8 | 0.8 | 0.8 | 0.8 | 0.8 |
| Linear alkyl benzene sulphonic acid | 14.5 | 14.5 | 14.5 | 14.5 | 14.5 | 14.5 | 14.5 |
| C14-15 EO7 | 9.0 | 9.0 | 9.0 | 9.0 | 9.0 | 9.0 | 9.0 |
| C12-14 AE3S | 2.1 | 2.1 | 2.1 | 2.1 | 2.1 | 2.1 | 2.1 |
| TPK Fatty acid | 4.0 | 4.0 | 4.0 | 4.0 | 4.0 | 4.0 | 4.0 |
| Diethylene triamine penta methylene phosphonic acid, sodium salt | 0.6 | 0.6 | 0.6 | 0.6 | 0.6 | 0.6 | 0.6 |
| Trans-sulphated ethoxylated hexamethylene diamine quaternary zwitterionic | 1.4 | 1.4 | 1.4 | 1.4 | 1.4 | 1.4 | 1.4 |
| Ethanol | 0.9 | 0.9 | 0.9 | 0.9 | 0.9 | 0.9 | 0.9 |
| 1-hydroxyethane 1,1-diphosphonic acid (HEDP) | | 1.8 | 1.8 | — | — | — | — |
| Citric acid | — | — | — | 1.5 | 1.5 | — | — |
| Sodium carbonate | — | — | — | — | — | 1.0 | 1.0 |
| Additional ethanol | — | — | 2.3 | — | 2.1 | — | 2.3 |
| Additional sodium hydroxide | — | 0.6 | 0.7 | 0.9 | 0.9 | — | — |
| Sulphuric acid | 0.07 | — | — | — | — | 0.6 | 0.6 |
| Water | to 100% | to 100% | to 100% | to 100% | to 100% | to 100% | to 100% |
| pH (10% dil) | 8.30 | 8.15 | 8.25 | 8.25 | 8.34 | 8.26 | 8.47 |
| % liquid crystalline phase | 0% | 15% | 2% | 10% | 2% | 10% | 0% |

*comparative

-continued

| Ingredient | Base Mix 8 (Inventive) | Base Mix 9 (Comparative) |
|---|---|---|
| Calcium Chloride | — | 0.02 |
| Water | Top to 100 | Top to 100 |

Base mix 8 and base mix 9 (comparative) were processed to provide, respectively, finished product 1 and finished product 2, by adding the following ingredients:

| Ingredient | Inventive process | Comparative process |
|---|---|---|
| Base mix 8 | 62.30 | — |
| Base mix 9 | — | 67.000 |
| Citric acid | 3.15 | — |
| Calcium chloride | 0.01 | — |
| Sodium hydroxide | 1.900 | — |
| Perfume | 0.800 | 0.800 |
| Brightener 36 | 0.080 | 0.080 |
| Structurant (hydrogenated castor oil) | 0.250 | 0.400 |

| | Finished Product 1 (Inventive) | Finished Product 2 (Comparative) |
|---|---|---|
| Sodium hydroxide | 3.620 | 3.620 |
| Sodium cumene sulfonate | 0.450 | 1.750 |
| Linear alkyl benzene sulphonic acid | 11.000 | 11.600 |
| C14-15 EO7 | 5.800 | 5.800 |
| Diethylene triamine penta methylene phosphonic acid | 0.500 | 0.500 |
| TPK fatty acid | 2.600 | 2.600 |
| Trans-sulphated Ethoxylated hexamethylene diamine quaternary zwitterionic | 0.600 | 0.600 |
| C12-14 AE3S | 1.200 | 1.200 |
| Ethanol | 1.000 | 1.000 |
| Citric acid | 3.140 | 3.140 |
| Calcium Chloride | 0.010 | 0.010 |
| Structurant (hydrogenated castor oil) | 0.250 | 0.400 |
| Water and minors | Top to 100 | Top to 100 |
| % liquid crystalline phase | 55% | 5% |

Since base mix 8 comprised less hydrotrope, significantly more liquid crystalline phase was present in Finished Product 1 than Finished Product 2. As a result, much less external structurant is required in order to provide the Finished Product with the desired structuring, and viscosity profile.

Base mix 10 (for use in processes of the present invention) and base mix 11 (for use in comparative processes) were prepared by simple mixing.

Base mix 10 comprised a total of 1.73 wt % of hydrotrope (sodium cumene sulphonate) and organic non-aminofunctional solvent (ethanol) in order to be both isotropic and stable. In contrast, base mix 9 comprised a total of 3.47 wt % of hydrotrope (sodium cumene sulphonate) and organic non-aminofunctional solvent (ethanol) in order to provide a stable, isotropic base.

| Ingredient | Base Mix 10 (Inventive) | Base Mix 11 (Comparative) |
|---|---|---|
| Sodium hydroxide | 2.52 | 5.36 |
| Sodium cumenesulfonate | 0.80 | 2.61 |
| Linear alkyl benzene sulphonic acid | 14.47 | 13.45 |
| C14-15 EO7 | 9.00 | 8.37 |
| C12-14 AE3S | 2.10 | 1.95 |
| Diethylene triamine penta methylene phosphonic acid | 0.63 | 0.59 |

-continued

| Ingredient | Base Mix 10 (Inventive) | Base Mix 11 (Comparative) |
|---|---|---|
| TPK fatty acid | 4.00 | 3.72 |
| Trans-sulphated Ethoxylated hexamethylene diamine quaternary zwitterionic | 1.40 | 1.30 |
| Ethanol | 0.93 | 0.86 |
| Citric acid | | 4.77 |
| HEDP | — | — |
| Calcium Chloride | — | 0.02 |
| Water | Top to 100 | Top to 100 |

Base mix 10 and base mix 11 (comparative) were processed to provide, respectively, finished product 3, in addition to comparative finished products 4 and 5, by adding the following ingredients:

| Ingredient | Inventive process | Inventive process | Comparative process |
|---|---|---|---|
| Base mix 10 | 62.30 | 62.30 | — |
| Base mix 11 | — | — | 67 |
| Citric acid | 3.20 | — | — |
| HEDP | — | 2.75 | — |
| Calcium chloride | 0.01 | 0.01 | — |
| Sodium hydroxide | 2.02 | 1.62 | — |
| Perfume | 0.800 | 0.800 | 0.800 |
| Brightener 36 | 0.080 | 0.080 | 0.080 |
| Structurant (hydrogenated castor oil) | 0.25 | 0.25 | 0.40 |

| | Finished Product 3 (Inventive) | Finished Product 4 (Inventive) | Finished Product 5 (Comparative) |
|---|---|---|---|
| Sodium hydroxide | 3.590 | 3.190 | 3.590 |
| Sodium cumene sulfonate | 0.500 | 0.500 | 1.750 |
| Linear alkyl benzene sulphonic acid | 10.015 | 10.015 | 10.615 |
| C14-15 EO7 | 5.607 | 5.607 | 5.607 |
| Diethylene triamine penta methylene phosphonic acid | 0.392 | 0.392 | 0.392 |
| TPK fatty acid | 2.492 | 2.492 | 2.492 |
| Trans-sulphated Ethoxylated hexamethylene diamine quaternary zwitterionic | 0.872 | 0.872 | 0.872 |
| C12-14 AE3S | 1.308 | 1.308 | 1.308 |
| Ethanol | 0.579 | 0.579 | 0.579 |
| Citric acid | 3.20 | — | 3.20 |
| HEDP | — | 2.75 | — |
| Calcium Chloride | 0.010 | 0.010 | 0.010 |
| Structurant (hydrogenated castor oil) | 0.25 | 0.25 | 0.40 |
| Water and minors | Top to 100 | Top to 100 | Top to 100 |
| % liquid crystalline phase | 40% | 30% | 10% |

Again, since base mix 10 comprised less hydrotrope, significantly more liquid crystalline phase was present in Finished Products 3 and 4, than for Finished Product 5. As a result, much less external structurant was required in order to provide the Finished Product with the desired structuring, and viscosity profile.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A process for making a detergent composition comprising the steps of:

a) providing a isotropic base mix, wherein the base mix comprises:

i. greater than about 15 wt % of surfactant, the surfactant comprising an anionic surfactant selected from the group consisting of alkyl sulphates, alkyl ethoxy sulphates, alkyl sulphonates, alkyl benzene sulphonates, fatty acid salts, and mixtures thereof, and ii. 0.1 wt % to 1.2 wt % of a non-surfactant salts;

iii. between 1 wt % to 7 wt % of fatty acid;

iv. a hydrotrope, wherein the hydrotrope is selected from the group consisting of sodium xylene sulfonate, potassium xylene sulfonate, ammonium xylene sulfonate, sodium toluene sulfonate, potassium toluene sulfonate, ammonium toluene sulfonate, sodium cumene sulfonate, potassium cumene sulfonate, ammonium cumene sulfonate, a mixtures thereof;

b) adding non-surfactant salt to the isotropic base mix such that a resultant liquid detergent composition comprises at least about 15% of a liquid crystalline phase, the non-surfactant salt being selected from the group consisting of salts of ethylenediaminetetraacetic acid (EDTA), salts of diethylene triamine pentaacetic acid (DTPA), salts of hydroxyethane diphosphonic acid (HEDP), salts of diethylene triamine penta methylene phosphonic acid, and mixtures thereof; wherein the resultant liquid detergent composition further comprises from 12% to 30%, by weight of the liquid detergent composition, of surfactant.

2. The process according to claim 1, wherein the non-surfactant salt added to the isotropic base mix in step (b) is added to provide a level of at least about 1.5 wt % of non-surfactant salt in the liquid detergent composition.

3. The process according to claim 1, wherein the surfactant in the base mix of step (a) further comprises nonionic surfactant.

4. The process according to claim 1, wherein the base mix comprises less than about 15% by volume of liquid crystalline phase.

5. The process according to claim 1, further comprising:

c) adding an external structurant selected from the group consisting of: non-polymeric crystalline, hydroxyl functional structurants; microfibrillated cellulose; uncharged hydroxyethyl cellulose; uncharged hydrophobically modified hydroxyethyl cellulose; hydrophobically modified ethoxylated urethanes; hydrophobically modified non-ionic polyols; and mixtures thereof.

* * * * *